US006629814B2

(12) United States Patent
McEwen et al.

(10) Patent No.: US 6,629,814 B2
(45) Date of Patent: Oct. 7, 2003

(54) LOW PROFILE PUMP

(75) Inventors: Stephen N. McEwen, Bowling Green, OH (US); Richard A. Hallett, Delta, OH (US)

(73) Assignee: Henry Filters, Inc., Bowling Green, OH (US)

( * ) Notice: Subject to any disclaimer, the term of this patent is extended or adjusted under 35 U.S.C. 154(b) by 0 days.

(21) Appl. No.: 09/811,917

(22) Filed: Mar. 19, 2001

(65) Prior Publication Data

US 2003/0091425 A1 May 15, 2003

Related U.S. Application Data

(60) Provisional application No. 60/226,840, filed on Aug. 22, 2000.

(51) Int. Cl.[7] ..... F04D 29/40

(52) U.S. Cl. ..... 415/1; 415/205; 415/206

(58) Field of Search ..... 415/56.1, 56.2, 415/203, 204, 205, 224, 225, 206; 417/423.3, 423.14, 424.1, 199.2, 200

(56) References Cited

U.S. PATENT DOCUMENTS

| | | | | |
|---|---|---|---|---|
| 1,100,491 A | | 6/1914 | Rose | |
| 1,128,822 A | | 2/1915 | Sparks | |
| 1,215,282 A | | 2/1917 | Kieser | |
| 1,366,149 A | | 1/1921 | Applin | |
| 2,030,381 A | | 2/1936 | Lowe | |
| 2,433,156 A | | 12/1947 | Pezzillo | |
| 2,890,660 A | | 6/1959 | Umbricht | |
| D195,792 S | | 7/1963 | Breger | |
| D212,132 S | | 8/1968 | Lewis | |
| 3,630,373 A | | 12/1971 | Grazen | |
| 3,637,331 A | | 1/1972 | Smith | |
| 3,736,075 A | | 5/1973 | Otto | |
| D233,260 S | | 10/1974 | Sadler | |
| 4,076,179 A | * | 2/1978 | Tsukube | 241/46.11 |
| D252,516 S | | 7/1979 | McGraw | |
| 4,331,537 A | | 5/1982 | Klauck | |
| 4,376,049 A | | 3/1983 | Valentino | |
| 4,475,868 A | * | 10/1984 | Renger | 415/213 A |
| 4,592,700 A | * | 6/1986 | Toguchi et al. | 415/213 A |
| 4,778,336 A | | 10/1988 | Hussain | |
| D305,124 S | | 12/1989 | Singhoff | |
| 5,035,583 A | * | 7/1991 | Vaught | 417/200 |
| 5,486,092 A | * | 1/1996 | Borg et al. | 415/225 |

* cited by examiner

*Primary Examiner*—Ninh H. Nguyen
(74) *Attorney, Agent, or Firm*—Howard & Howard

(57) ABSTRACT

The present invention relates to a fluid handling system including a collection trough and pump assembly. A centrifugal pump is mounted in the path of cutting fluid that needs to be pumped from a collection system and discharged. A wide and narrow inlet mouth lies very low on the factory floor enabling the centrifugal pump to be mounted right on the floor and not within the floor. An optional vacuum system provides suction within the centrifugal pump that aids in priming the pump at start up and in removing air from a pump chamber within the pump, thus allowing more efficient pumping to take place. An impeller rotates within the pump creating a vortex within the pump chamber which facilitates movement of dirty cutting fluid including metal particles to be pumped through to a discharge outlet.

7 Claims, 3 Drawing Sheets

LOW PROFILE PUMP

This invention claims priority to Provisional Patent Application No. 60/226,840 filed Aug. 22, 2000.

BACKGROUND OF THE INVENTION

The present invention relates to a fluid handling system and more particularly, to a cutting fluid handling system that can be used in situations where a fluid stream close to the floor is needed.

Fluid handling systems are commonly used in manufacturing processes to receive cutting fluid, chips, swarf, and other materials from the manufacturing process, filter the fluid, and then deliver that fluid back to the machining equipment. In a typical manufacturing process, there will be numerous machine tools performing various machining, grinding, or part finishing operations. In many of the operations, cutting fluid is used to extend tool life, facilitate the machining operation, and to carry away debris created in the machining process. This fluid and resulting debris is typically delivered to a trough, a conveyor or other fluid transport system which is connected to a pump for pumping the fluid into a filtering system.

Troughs that have been used are traditionally mounted within the floor of the manufacturing facility. In this way, there were few restrictions on the depth and slope of the trough which could be installed. With adequate depth and slope, the fluid and debris can easily travel down the trough to a standard pump where it can then be pumped into the filter. It should be understood, that for optimal operation and flow equilibrium, the surface of the cutting fluid should be parallel to the bottom of the trough as the fluid is flowing through the trough. Further, the depth of the fluid at the end of the trough must be equal or higher to the height of the impeller within the pump in order for the pump to operate. With these considerations, the designer of the fluid handling system selects a desired pump, determines the depth required for the fluid and the proper slope of the trough to obtain the flow and velocity necessary to move the used cutting fluid and debris down the trough to the pump. Due to the ability to mount the trough in the floor of the manufacturing facility, the designer could select any standard pump.

Although the above system works effectively, it limits the versatility of a manufacturing facility and does pose the potential for environmental problems by contaminating the soil in which the trough is installed in the event of a leak in the trough. The fluid handling trough is permanently mounted within the facility floor requiring machinery to be mounted in fairly close proximity to the trough. This restricts the ability of the facility to be rearranged and used for different purposes. Still further, if additional equipment or different equipment is installed, the flow characteristics of the trough may not be sufficient, requiring the trough to be removed and another installed which, due to installation in the floor, is an expensive endeavor.

In view of the limitations of mounting troughs in the floor, it is desirable to mount the fluid handling system above the floor, and below the discharge outlet of the machinery. It should be appreciated by those of ordinary skill in the art, typical machinery is designed so that the work surface is approximately at the height of the waist of the user. As a result, the fluid outlet is typically even lower than waist height. This leaves a very short distance between the floor and the outlet in order to mount the fluid handling trough. As should be appreciated, the trough must have an adequate slope in order to provide the necessary fluid velocity to move the fluid and debris to the end of the trough for entry into a pump for pumping into the filter system. Furthermore, the trough height is limited by the same limitations of height which limits the permissible slope. In order to obtain the appropriate fluid velocity and to handle the appropriate amount of fluid being discharged, the trough must be designed so that it is wide and shallow. In this way, the fluid discharge from numerous machining operations can be handled and handled at the appropriate velocity.

However, this creates a problem with the use of a standard pump because the fluid exiting the trough and entering the pump is very close to the floor and wide. As indicated above, the pump cannot operate unless the impeller is in contact with the fluid being pumped. A standard pump would not function properly if mounted on the floor because the impeller is considerably higher than the fluid level at the end of the trough. This situation would therefore require that a standard pump be mounted in an excavation at the end of the trough thereby creating the same problems of cost, loss of flexibility to easily move the system, and environmental concerns.

The use of conveyors also creates problems with traditional pump systems. Traditional conveyors are usually mounted within either the floor of a factory or within the base of a machine. When mounted within the floor, the conveyor systems have similar flexability issues as the troughs described above. When the conveyors are attached to the base of the machine, other mechanisms are required to separate the contaminants from the fluid. Such mechanisms include additional shredders, crushers, and bins to reduce the contaminants to a size capable of entering the traditional pump. Additional mechanisms such as those described require additional maintenance, cost, and ineffecincies in a fluid handling system. Additionally, traditional conveyors often require auxiliary pumps to speed up the fluid entering the main pump due to the conveyor's limited velocity capability. Additional pumps also add cost, reliability, and environmental concerns to the overall fluid handling system.

Thus, what is desired is an effecient fluid handling system that is capable of receiving large contaminants in a highly variable rate of fluid at a level close to the floor.

SUMMARY OF THE INVENTION

An improved fluid handling system including an improved collection trough and pump assembly. The improved collection trough is mounted above the floor and is specifically constructed with a shape and slope to provide flow of the fluid to an improved pump assembly. The inventive pump receives the dirty cutting fluid from a trough and allows very large objects, even tools which have been inadvertently dropped into the coolant system, to be received and pumped through the centrifugal pump. In general the fluid is delivered to a pump chamber beneath the impeller. The impeller then creates a vortex within the pump chamber to move the fluid and any solids within the fluid out through a discharge outlet.

The inlet mouth of the innovative centrifugal pump has a specific wide and shallow profile and is connected to a vacuum system which can be used to help prime the pump and keep it primed during operation. The vacuum is needed to help prime the pump only if the fluid is not entering the inlet mouth at a sufficient velocity. The suction from the vacuum system also serves to remove the presence of air within the pump that may impede the flow of dirty cutting fluid. The suction also serves to remove air entrained in the fluid, thereby improving the effeciency and liquid handling capability of the pump. The inlet mouth profile of the inventive centrifugal pump facilitates movement of the fluid and the particles, and also lies low to the floor.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
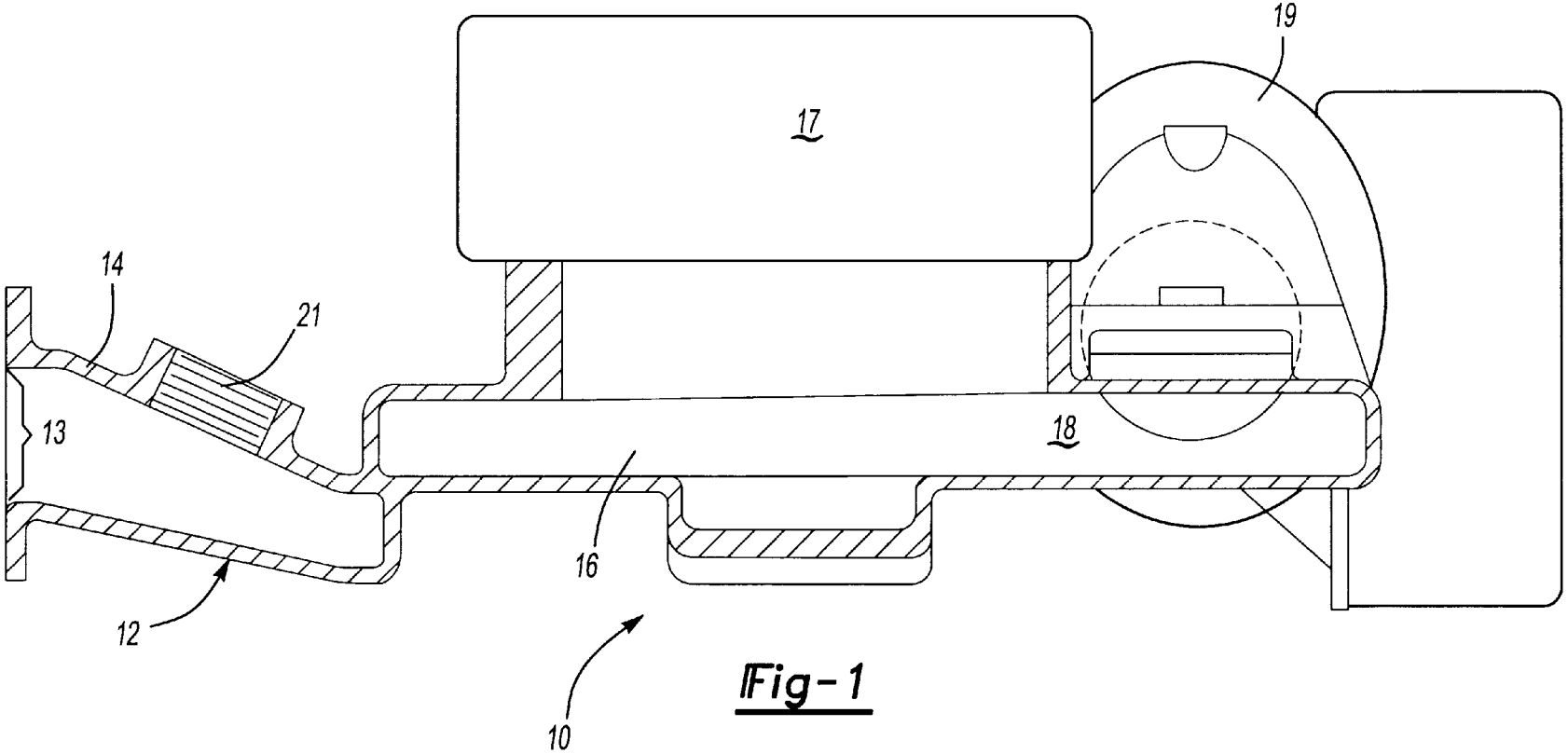
FIG. 1 is a perspective cross section of the lower third of the centrifugal pump assembly of the present invention.

Referring to the Figures, wherein like numerals indicate like or corresponding parts throughout the several views, FIG. 1 schematically shows a partial view of the centrifugal pump 10 of the present invention. Centrifugal pump 10 is mounted in the path of cutting fluid or oil which needs to be pumped from a collection system (not shown) and discharged from the pump through discharge outlet 18 out through discharge pipe 19. The collection system (not shown) could be a trough, a conveyor, a pipe, or any other fluid transportation system. The collection system collects and transports the dirty cutting fluid which can include very large objects, even tools which have been inadvertently dropped into the cutting fluid stream into centrifugal pump 10 through inlet mouth 12. Inlet mouth 12 lies very low on the factory floor enabling centrifugal pump 10 to be mounted right on a floor (not shown) and not within the floor.

Figure 2:
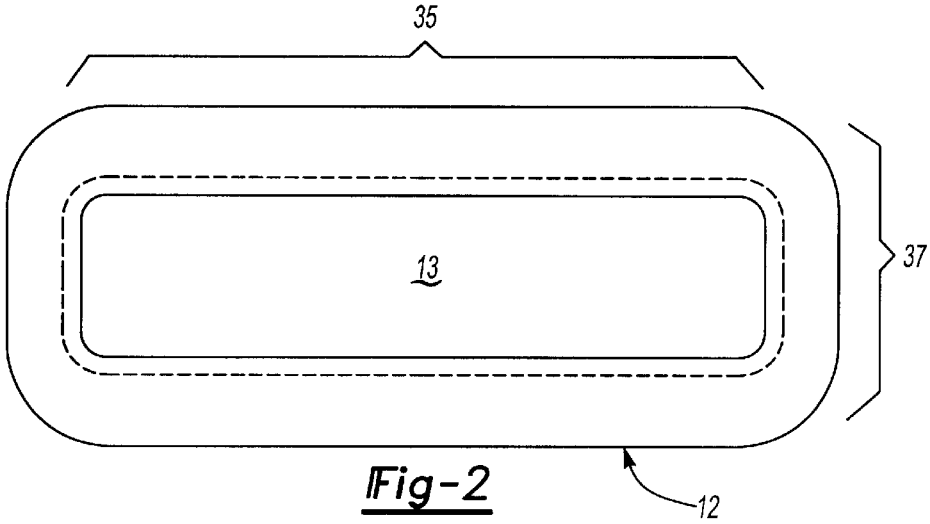
FIG. 2 is a cross section of the inlet opening of the centrifugal pump assembly.

The opening of inlet mouth 12 is wide and narrow for ingress of fluid from the collection system. FIG. 2 shows a view of the opening 13 of inlet mouth 12 showing an inlet mouth width 35 and an inlet mouth height 37. In the illustrated preferred embodiment, opening 13 is provided with a width dimension of 24 inches and a height dimension of 4.5 inches. Preferably the width is at least twice the height, while more preferably the width is at least five times the height. The preferred dimensions accommodate the inflow of dirty cutting fluid containing metal particles while being narrow enough to provide a low profile to allow inlet mouth 12 to be mounted directly on a factory floor.

As shown in FIG. 1, inlet mouth 12 includes an upper wall 14 with an aperture 21 for clean out purposes. Dirty cutting fluid is passed from inlet mouth 12 to pump chamber 16. Pump chamber 16 preferably lies directly under centrifugal pumping element 17. An alternative embodiment includes centrifugal pumping element 17 within or partially within pump chamber 16. Having centrifugal pumping element 17 above pump chamber 16 allows for larger particles to pass through centrifugal pump 10 without interfering with the centrifugal pumping element 17. However, efficiency of centrifugal pump 10 may be improved by moving the centrifugal pumping element 17 closer to the fluid in pump chamber 16. This may be accomplished if the fluid being pumped contains few large particles. Inlet mouth 12 may be planar with or preferably below the pump chamber. As can be seen from FIG. 3, the chamber 16 is preferably below a pump impeller 23 that is connected to the centrifugal pumping element that is rotatable about a vertical axis. Impeller 23 rotates within the fluid creating a vortex within pump chamber 16 which facilitates movement of dirty cutting fluid including metal particles to be pumped through to a discharge outlet 18. The centrifugal pumping element 17 is preferably connected to a motor 26 that provides the rotation. Dirty cutting fluid then passes through discharge outlet 18 which may be connected below pump chamber 16, but is preferably connected planar to pump chamber 16.

Figure 3:
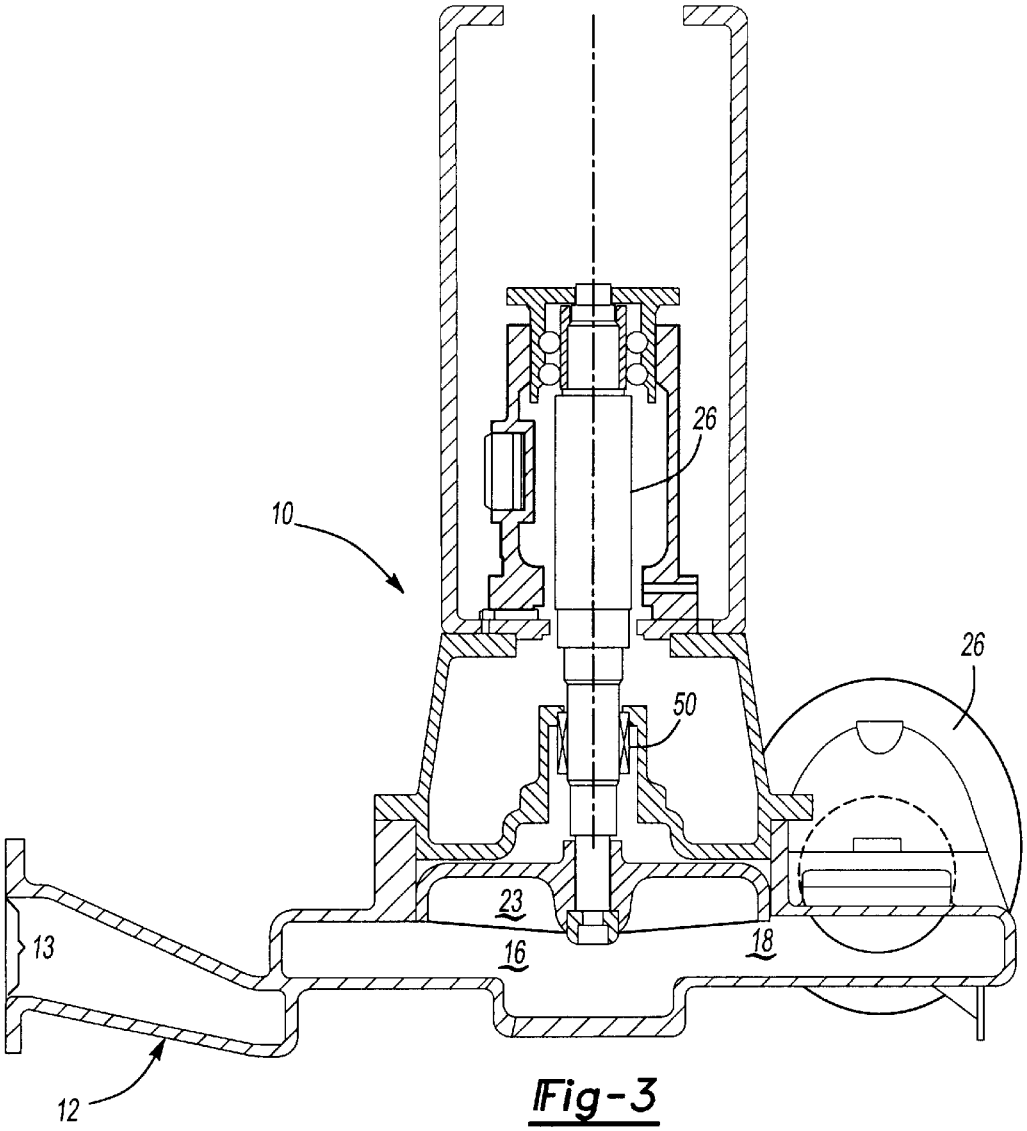
FIG. 3 is a perspective cross section of the entire centrifugal pump assembly.
Figure 4:
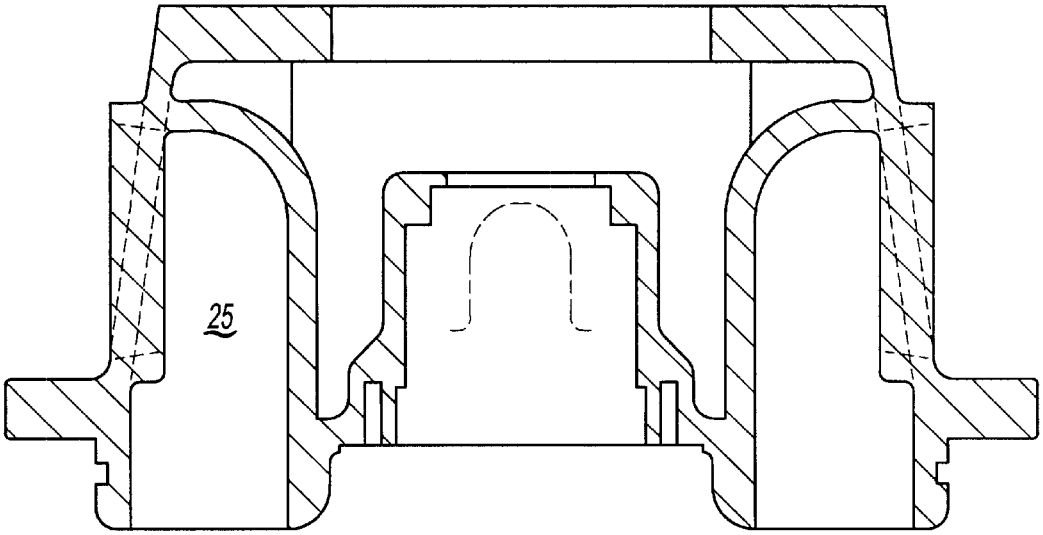
FIG. 4 is a cross section of the centrifugal pump chamber showing the vacuum connection.
Figure 5:
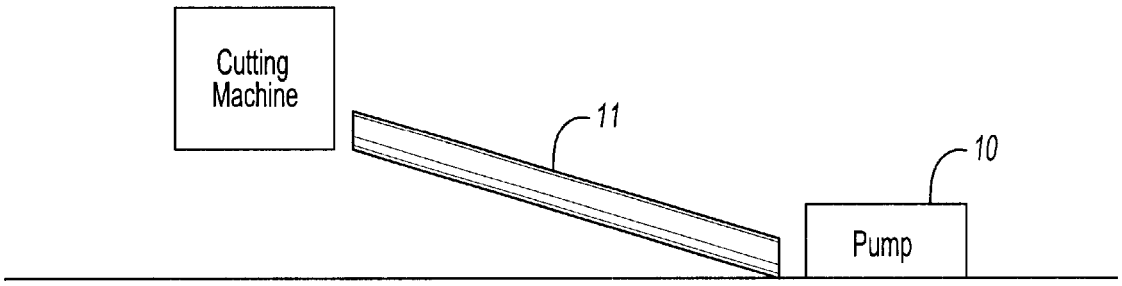
FIG. 5 is a schematic view of the centrifugal pump relative to a cutting machine.

FIG. 4 is a view of the back side of the pump 10 as seen in FIGS. 1 and 3. With reference to FIG. 4, an opening 25 is shown which contains a vacuum connection to a vacuum system (not shown) which may be any suitable known vacuum system. The vacuum system can be used to help prime the centrifugal pump 10 during start up and help keep it primed during operation. The use of the vacuum in starting the pump depends on the velocity of the entering fluid. If the velocity of the entering fluid entering the pump is sufficient to fill the pump chamber the vacuum is not needed at start up of centrifugal pump 10. The vacuum system provides suction to remove air from pump 10, thus allowing more efficient pumping to take place.

Although the invention has been described in detail with reference to certain preferred embodiments, variations and modifications exist within the scope and spirit of the invention as described and as defined in the following claims.

What is claimed is:

1. A centrifugal pump assembly for pumping fluid from a fluid collection assembly, comprising:

a centrifugal pumping element rotatable about a vertical axis;

a pump chamber disposed below said pumping element;

an inlet mouth having an inlet mouth width and an inlet mouth height for ingress of fluid from a collection system to said pump chamber;

said inlet mouth disposed below said pump;

a discharge outlet;

said pump assembly inlet mouth width being greater than said inlet mouth height; and an upper wall of said inlet mouth and an aperture in said upper wall for cleaning said inlet mouth.

2. A method for pumping contaminated fluid collected at a floor level, comprising the steps of:

a) receiving contaminated fluid into a wide pump inlet mouth from a fluid collection system mounted on a floor, the pump inlet mouth having a width and a height with the width greater than the height;

b) moving the fluid from the pump inlet mouth into a pump chamber;

c) discharging the fluid out of the pump chamber through a discharge outlet by creating a vortex in the fluid by an impeller mounted above the pump chamber; and d) priming the pump at start up and removing air from the fluid by a vacuum attached to the pump chamber.

3. A centrifugal pump assembly for pumping fluid from a fluid collection assembly comprising:

a centrifugal pumping element rotatable about a vertical axis;

a pump chamber disposed below said pumping element;

an inlet mouth having an inlet mouth width and an inlet mouth height for ingress of fluid from a collection system to said pump chamber;

a discharge outlet; and said inlet mouth including an upper wall defining an aperture therein for cleaning said inlet mouth.

4. A method for pumping contaminated fluid collected at a floor level comprising the steps of:

a) receiving contaminated fluid into a wide pump inlet mouth from a fluid collection system mounted on a floor;

b) moving the fluid from the pump inlet mouth into a pump chamber;

c) discharging the fluid out of the pump chamber through a discharge outlet by creating a vortex in the fluid by an impeller mounted above the pump chamber; and d) priming the pump at start-up and removing air from the fluid by a vacuum attached to the pump chamber.

5. A method for pumping contaminated fluid collected at a floor level comprising the steps of:

a) receiving contaminated fluid into a wide pump inlet mouth from a fluid collection system mounted on a floor;

b) moving the fluid from the pump inlet mouth into a pump chamber;

c) removing entrapped air from an area above an impeller by a vacuum attached to the pump chamber above the impeller; and d) discharging the fluid out of the pump chamber through a discharge outlet by creating a vortex in the fluid by the impeller.

6. A method as set forth in claim 5 including the step of priming the pump at start-up.

7. A method as set forth in claim 5 wherein the pump inlet mouth includes a width and a height with the width greater than the height.

* * * * *